US007277062B1

(12) United States Patent
Loyet

(10) Patent No.: US 7,277,062 B1
(45) Date of Patent: Oct. 2, 2007

(54) MULTI-RESONANT MICROSTRIP DIPOLE ANTENNA

(75) Inventor: Lowell Lee Loyet, Woodinville, WA (US)

(73) Assignee: AT&T Mobility II LLC, Atlanta, GA (US)

( * ) Notice: Subject to any disclaimer, the term of this patent is extended or adjusted under 35 U.S.C. 154(b) by 0 days.

(21) Appl. No.: 11/424,664

(22) Filed: Jun. 16, 2006

(51) Int. Cl.
*H01Q 9/28* (2006.01)

(52) U.S. Cl. ..... 343/795; 343/700 MS

(58) Field of Classification Search ..... 343/795, 343/801, 802, 810, 812, 813, 814, 816, 700 MS
See application file for complete search history.

(56) References Cited

U.S. PATENT DOCUMENTS 6,529,170 B1 * 3/2003 Nishizawa et al. ..... 343/795
6,965,353 B2 * 11/2005 Shirosaka et al. ..... 343/802

OTHER PUBLICATIONS

Nortel Networks. "GSM 900/1800/1900 Univity GSM Base Transceiver Station eCell" (2002) Product Bulletin, 2 pages, month not available.

Katherin. "UMTS Antennas from the World's Largest Antenna Supplier" (1999) Product-Marketing, Mobile Communication Antennas, 4 pages, month not available.

NOKIA. "Transmission Solution for Nokia Mobile Networks"(2000) Product Bulletin, 4 pages, month not available.

Katherin. "Technical Information and New Products: Cellular Systems" located at www.katherin.de/de/mca/techn-infos/download/9985654.pdf, last viewed Oct. 23, 2006, 16 pages.

* cited by examiner

*Primary Examiner*—Hoang V. Nguyen
(74) *Attorney, Agent, or Firm*—Amin, Turocy & Calvin, LLP

(57) ABSTRACT

A multi-band antenna for use, for example, in a wireless communications network, employs multi-resonant microstrip dipoles that resonate at multiple frequencies due to microstrip "islands." Gaps in the microstrips create an open RF circuit except for desired frequencies. At a desired frequency, RF energy sees a gap as a short circuit between an island and the rest of a dipole antenna, thus, resonating at the desired frequency. In one instance, the multi-band antenna includes a first, second, third, and fourth dipole elements. Gaps between the first and third dipole elements and the second and fourth dipole elements are sufficiently small that the first, second, third, and fourth dipole elements form a second dipole having a corresponding dipole wavelength longer than that of the first dipole.

22 Claims, 7 Drawing Sheets

MULTI-RESONANT MICROSTRIP DIPOLE ANTENNA

RELATED APPLICATIONS

This application is related to co-pending and co-assigned U.S. applications entitled "MULTI-BAND ANTENNA," filed on Jun. 16, 2006 and assigned Ser. No. 11/424,614 and "MULTI-BAND RF COMBINER," filed on Jun. 16, 2006 and assigned Ser. No. 11/424,639. The above-noted applications are incorporated herein by reference.

BACKGROUND

Wireless telephones and other wireless devices have become almost the de facto standard for personal and business communications. This has increased the competition between wireless service providers to gain the largest possible market share. As the marketplace becomes saturated, the competition will become even tougher as the competitors fight to attract customers from other wireless service providers.

As part of the competition, it is necessary for each wireless service provider to stay abreast of technological innovations and offer their consumers the latest technology. However, not all consumers are prepared to switch their wireless devices as rapidly as technological innovations might dictate. The reasons for this are varied and may range from issues related to cost to an unwillingness to learn how to use a new device or satisfaction with their existing device.

However, certain technological innovations may require different antenna technologies in order to deliver service to the wireless customer. For example, although Wide Band Code Division Multiple Access (WCDMA) and Global System for Mobile communications (GSM) technologies typically operate on different frequencies, and they may require separate antennas, a wireless provider may have customers using both types of technologies. In many areas, simply leasing or buying new antenna space for the new technology may be economical. However, in many areas, particularly in urban areas, the cost of obtaining additional leases as well as zoning and other regulatory issues can make retaining old technologies while introducing new technologies cost prohibitive.

Thus, it is desirable to have an antenna capable of simultaneously radiating and receiving signals from both technologies (i.e., a multi-band antenna). One attempted solution is the Kathrein brand multi-band omni antenna which was developed for E911 Enhanced Observed Time Difference (EOTD) deployments to measure adjacent cell sites downlink messaging for determining a mobile location. However, the Kathrein brand antenna design has limited RF performance due to its unique antenna element design which limits gain to unity.

SUMMARY

The following presents a simplified summary of the subject matter in order to provide a basic understanding of some aspects of subject matter embodiments. This summary is not an extensive overview of the subject matter. It is not intended to identify key/critical elements of the embodiments or to delineate the scope of the subject matter. Its sole purpose is to present some concepts of the subject matter in a simplified form as a prelude to the more detailed description that is presented later.

The subject matter provides a multi-band antenna for use, for example, in a wireless communications network. The multi-band antenna employs multi-resonant microstrip dipoles that resonate at multiple frequencies due to microstrip "islands." Gaps in the microstrips create an open RF circuit except for desired frequencies. At the desired frequency, RF energy sees a gap as a short circuit between an island and the rest of a dipole antenna, thus, resonating at the desired frequency. In one instance, the multi-band antenna includes first, second, third, and fourth dipole elements. The first dipole element is on a first side of a dielectric and the second dipole element is on a second side of the dielectric and oriented with respect to the first dipole element so as to form a first dipole. The third dipole element is also on the first side of the dielectric and is linearly displaced from the first dipole element in a direction parallel to the orientation of the first dipole wherein the displacement creates a gap between the first dipole element and the third dipole element. The fourth dipole element is on the second side of the dielectric linearly and is displaced from the second dipole element in a direction parallel to the orientation of the first dipole and opposite of the direction of displacement of the third dipole element from the first dipole element wherein the displacement creates a gap between the second dipole element and the fourth dipole element. The gaps between the first and third dipole elements and the second and fourth dipole elements are sufficiently small that the first, second, third, and fourth dipole elements form a second dipole having a corresponding dipole wavelength longer than that of the first dipole.

To the accomplishment of the foregoing and related ends, certain illustrative aspects of embodiments are described herein in connection with the following description and the annexed drawings. These aspects are indicative, however, of but a few of the various ways in which the principles of the subject matter may be employed, and the subject matter is intended to include all such aspects and their equivalents. Other advantages and novel features of the subject matter may become apparent from the following detailed description when considered in conjunction with the drawings.

DETAILED DESCRIPTION

Figure 1:
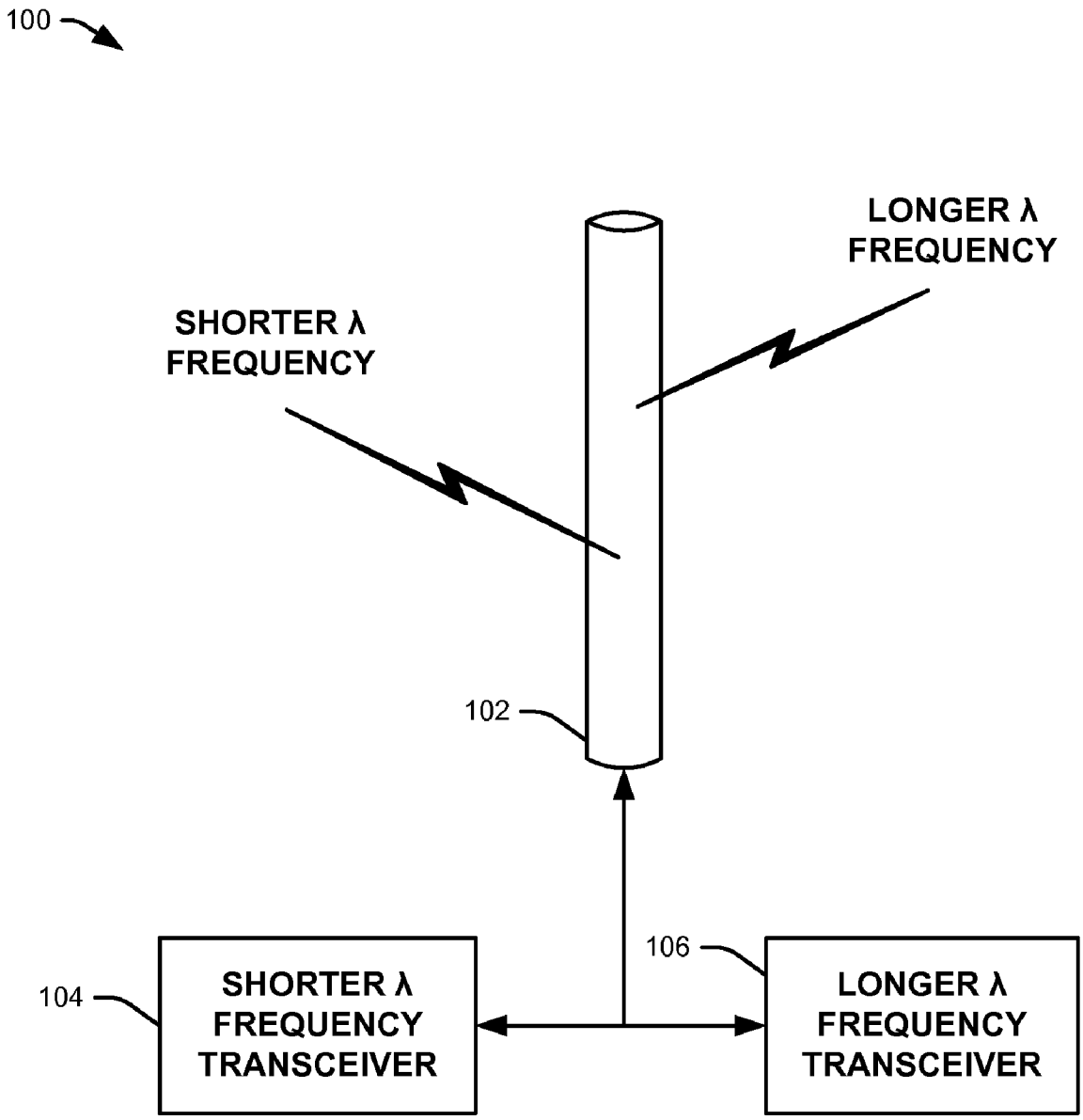
FIG. 1 is a block diagram of a multi-band antenna system in accordance with an aspect of an embodiment.

The subject matter is now described with reference to the drawings, wherein like reference numerals are used to refer to like elements throughout. In the following description, for purposes of explanation, numerous specific details are set forth in order to provide a thorough understanding of the subject matter. It may be evident, however, that subject matter embodiments may be practiced without these specific details. In other instances, well-known structures and devices are shown in block diagram form in order to facilitate describing the embodiments.

In FIG. 1, a block diagram of a multi-band antenna system 100 in accordance with an aspect of an embodiment is shown. The multi-band antenna system 100 is comprised of a multi-band antenna 102 that can transmit and/or receive different wavelengths, λ, from a shorter λ frequency transceiver 104 and from a longer λ frequency transceiver 106. Dipole elements of the multi-band antenna 102 employ "gaps" in the dipole elements that tune the dipole elements to see more than one desired wavelength (i.e., frequency). Wavelengths, with sufficient length, "jump" the gap and resonate the dipole element at the longer wavelength. In this manner, the dipole element acts like a multi-band dipole element. Thus, a single multi-band antenna 102 can replace multiple antennas that can only operate at a given frequency and/or can increase communication frequency bands when antenna installation space is limited. This provides a very cost effective and space effective alternative to multiple antenna installations.

Figure 2:
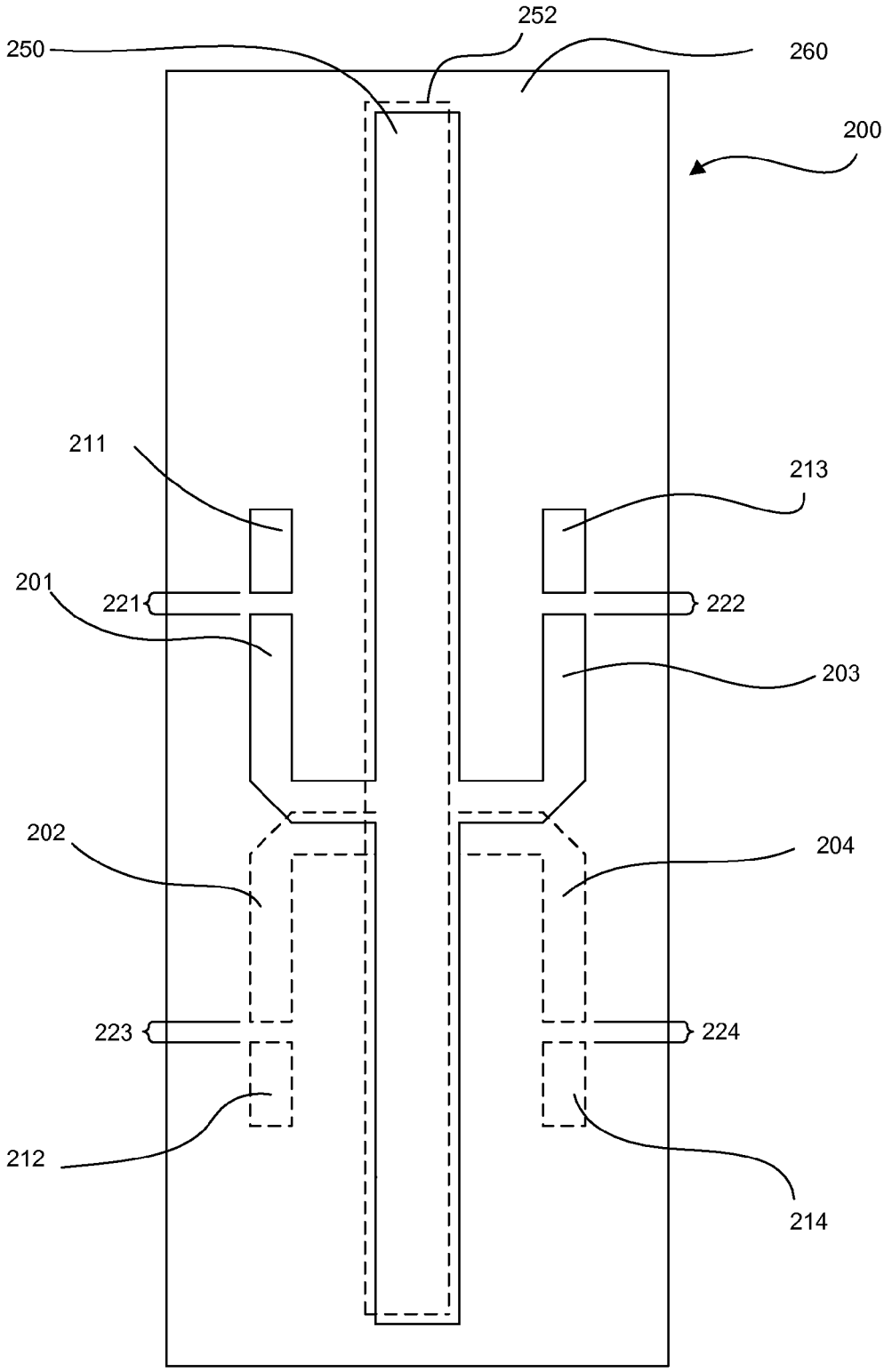
FIG. 2 depicts a side view of a multi-band antenna in accordance with an aspect of an embodiment.

Turning to FIG. 2, a side view of a multi-band antenna 200 in accordance with an aspect of an embodiment is depicted. The multi-band antenna 200 can be employed as, for example, one of the plurality of towers 730 depicted in FIG. 7. The multi-band antenna 200 is a microstrip multi-band collinear array with dipole elements 201-204 and 211-214 arranged on both sides of serial feedlines 250 and 252 and both sides of a dielectric material 260. The dielectric material 260 can be any RF dielectric such as, for example, a PTFE (polytetrafluoroethylene)/fiberglass composite. The elements 201, 203, 211, 213, and 250 on a first side of the multi-band antenna 200 are illustrated with solid lines and the elements 202, 204, 212, 214, and 252 on the second side of the multi-band antenna separated from the first side by the dielectric material 260 are represented by dashed lines in FIG. 2.

Serial feedlines (also referred to as microstrips) 250 and 252 and dipole elements 201-204 and 211-214 are constructed from a metal such as, for example, copper and the like. A pattern is etched and/or otherwise formed into each side of the dielectric material 260 corresponding to the locations of the serial feedlines 250 and 252 and the dipole elements 201-204 and 211-214 on that side of the dielectric material 260. Metal is then deposited into the pattern to form the feedlines 250 and 252 and the dipole elements 201-204 and 211-214. In the alternative, a metal sheet, such as, for example, copper, is attached and/or deposited on each side of the dielectric. The dipole element and feedline pattern is then formed by printing an acid resistant mask onto the metal and using an acid bath to remove the unpatterned metal.

The impedance of the feedlines 250 and 252 should approximately match the impedance of a transmission line carrying RF signals from a transmitter and/or to a receiver. For a coaxial transmission line, this impedance is typically around 50 ohms. The impedance of the dipole elements 201-204 and 211-214 should be approximately that of free space (i.e., approximately 377 ohms).

Dipole element 201 and dipole element 202 on the opposite side of dielectric material 260 form a dipole for a given first wavelength of radiation/reception. Similarly, dipole element 203 and 204 also form a dipole for the same wavelength of radiation/reception since the dipole formed by dipole elements 203 and 204 has an approximately equivalent length to the dipole formed by dipole elements 201 and 202. A gap 221-224 exists between dipole elements 201-204 and their corresponding dipole elements 211-214. For shorter wavelengths, the gaps 221-224 form an open circuit between dipole elements 201-204 and dipole elements 211-214. However, for longer wavelengths, if the gaps 221-224 are chosen correctly, the gaps 221-224 are effectively short circuited so that a longer dipole equal in length, for example, to the combined lengths of dipole elements 201-202, dipole elements 211-212, and gaps 221 and 223. Thus, dipole elements 201-202 and 211-212 form a dipole for a second wavelength of radiation longer than that of the first wavelength dipole. Therefore, the multi-band antenna 200 functions on two bands (i.e., two different wavelengths). The multi-band antenna 200 can also have a cylindrical radome (not shown) placed over the antenna structure for weather proofing. The multi-band antenna 200 is presented as an example of a multi-band antenna and is not meant to imply any architectural limitations.

Figure 3A:
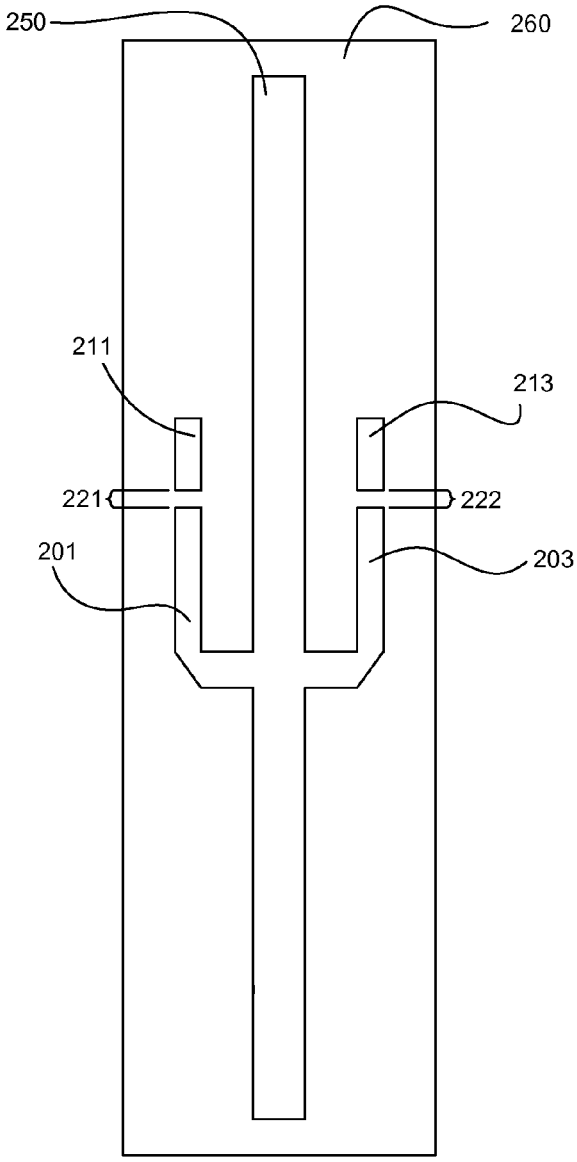
FIGS. 3A and 3B depict the two sides of the multi-band antenna in accordance with an aspect of an embodiment.
Figure 3B:
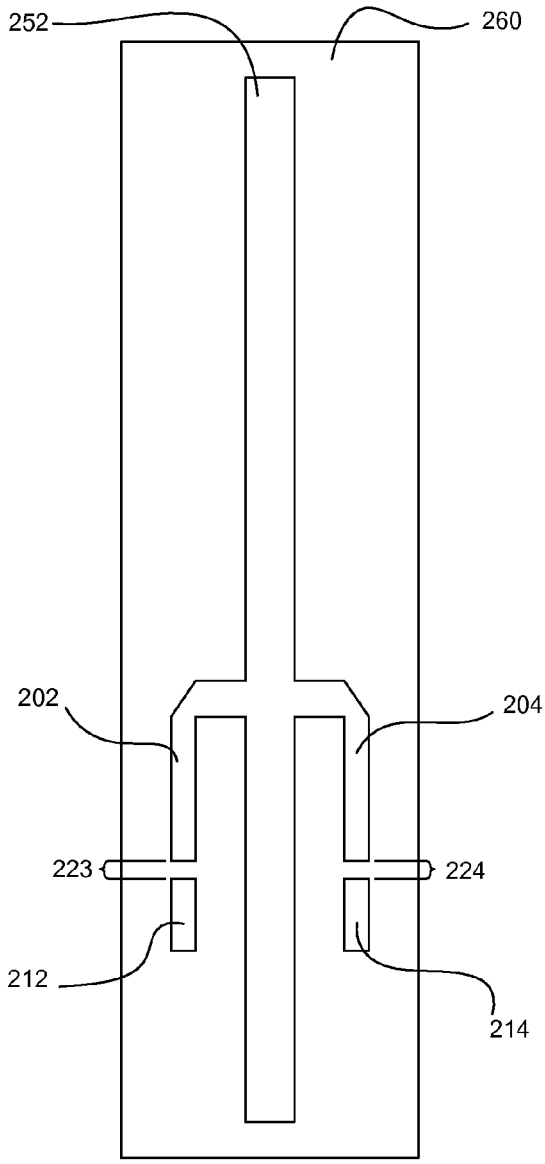

With reference to FIGS. 3A-3B, the two sides of the multi-band antenna 200 are depicted in accordance with an aspect of an embodiment. FIG. 3A depicts side 1 on the multi-band antenna 200. FIG. 3B depicts side 2 of the multi-band antenna 200. Both the views in FIG. 3A and FIG. 3B are from the same side, but represent a different cross-section of the multi-band antenna 200. In between the two cross-sections shown in FIG. 3A and FIG. 3B is a layer of dielectric material 260. The pattern of the microstrips (serial feedlines) 250 and 252, and the dipole elements 201-204 and 211-214, as described above, is etched and/or otherwise formed (for example, by utilizing a reversed mask process) in a dielectric material 260 and an electrically conductive material such as, for example, copper is deposited onto each side of the dielectric material 260 to form the multi-band antenna 200.

Figure 4:
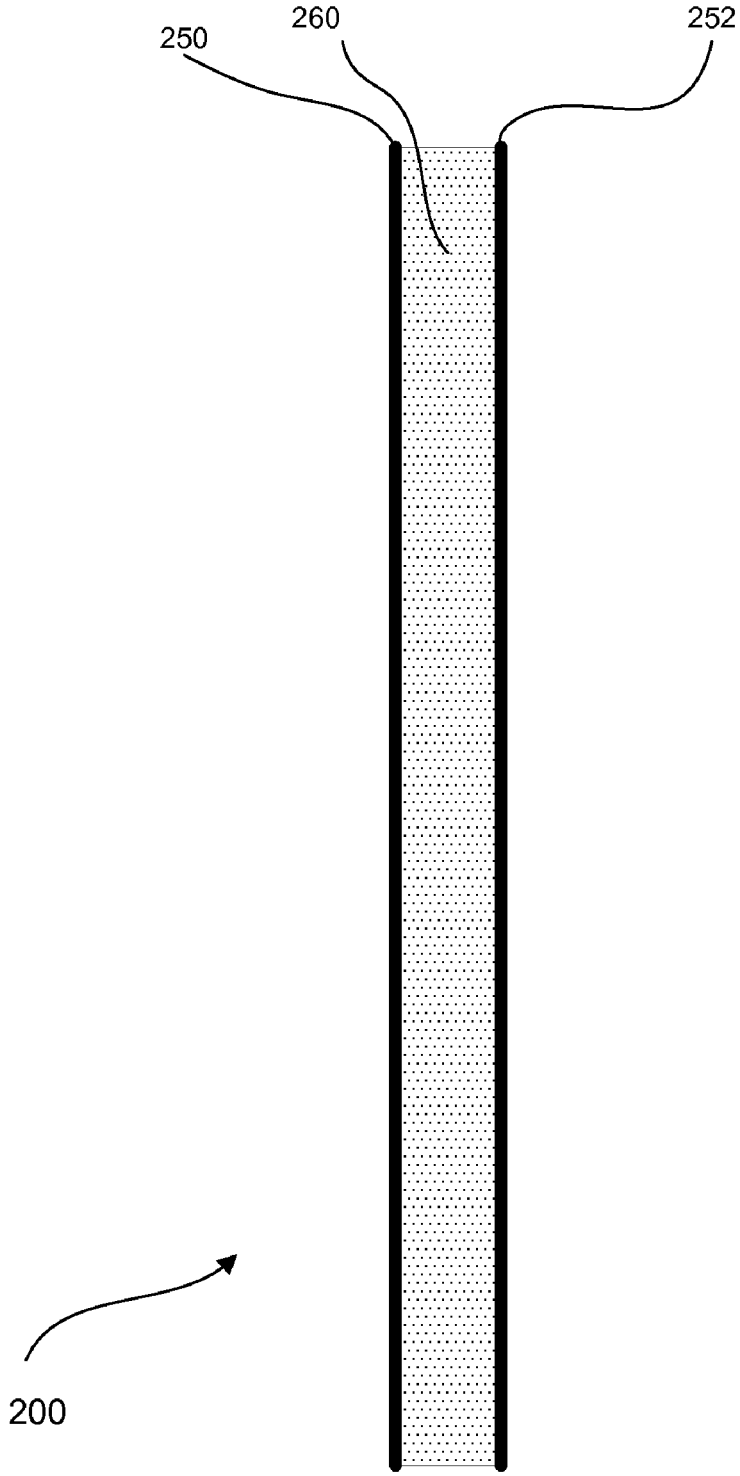
FIG. 4 depicts a side view of the multi-band antenna oriented ninety degrees away from the view depicted in FIG. 2 in accordance with an aspect of an embodiment.

Moving on to FIG. 4, a side view of the multi-band antenna 200 oriented ninety degrees away from the view depicted in FIG. 2 is shown in accordance with an aspect of an embodiment. In this view, it is apparent that microstrip (serial feedlines) elements 250 and 252 as well as associated dipole elements connected to microstrip (serial feedlines) elements 250 and 252 are separated from each other by dielectric material 260.

Figure 5:
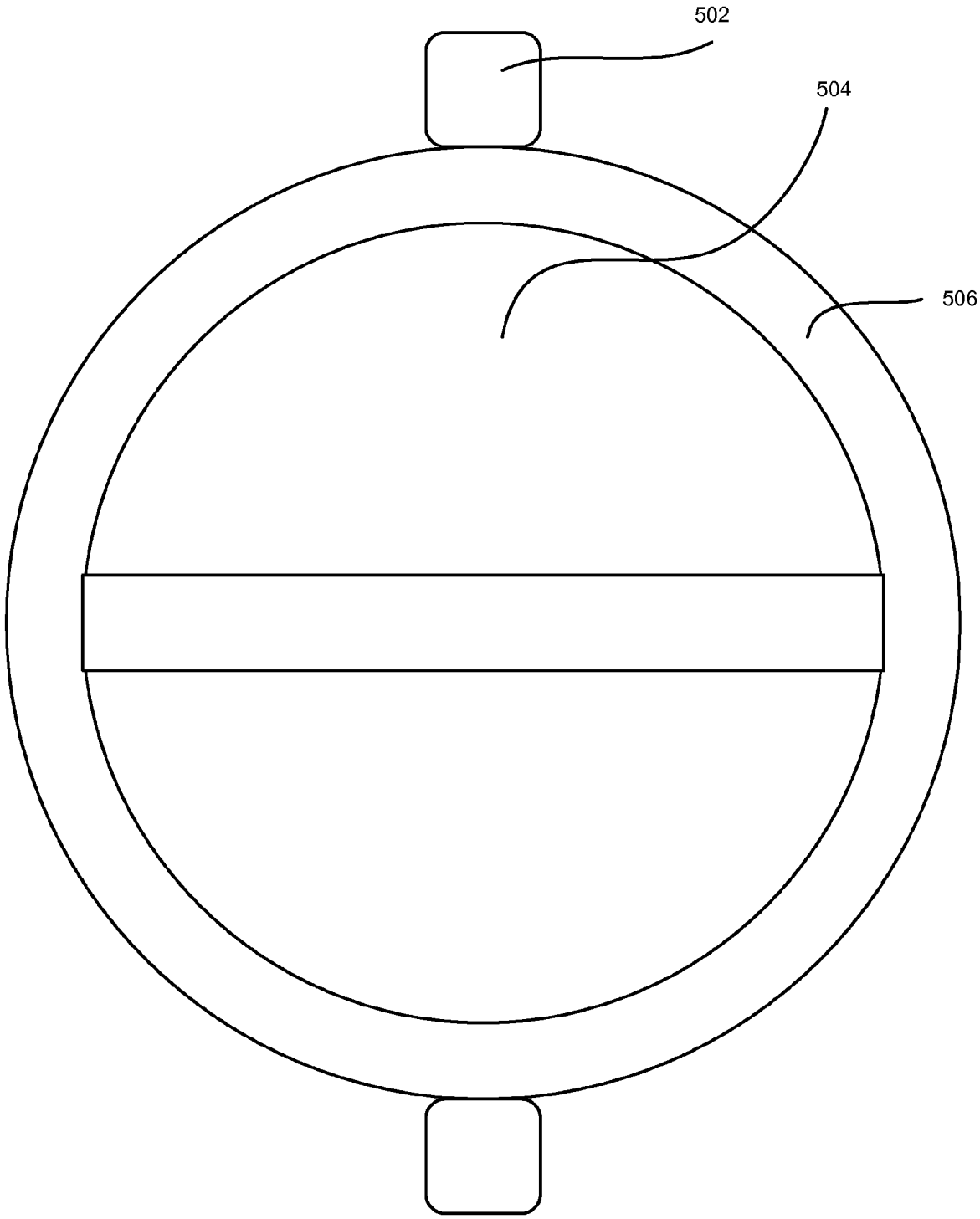
FIG. 5 depicts a diagram illustrating a multi-band antenna encased in a radome in accordance with an aspect of an embodiment.
Figure 6:
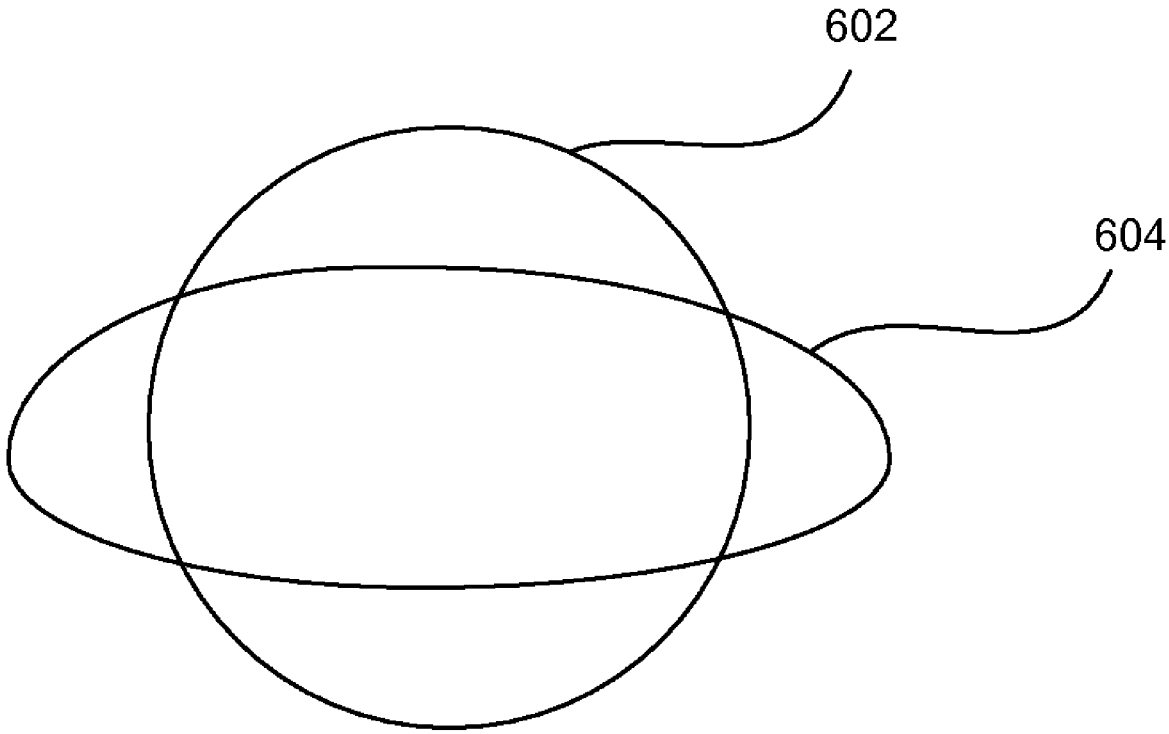
FIG. 6 depicts radiation patterns of a multi-band antenna with and without a parasitic element in accordance with an aspect of an embodiment.

Turning to FIG. 5, a diagram illustrating a multi-band antenna 504 encased in a radome 506 is depicted in accordance with an aspect of an embodiment. The multi-band antenna 504 tranceives multiple frequency bands similar to, for example, multi-band antenna 200 in FIG. 2 and is encased within the radome 506 which has a parasitic element 502 attached to the outside. Without the parasitic element 502, the radiation pattern of the multi-band antenna 504 is elliptical as illustrated in a radiation pattern 604 shown in FIG. 6. However, with the addition of parasitic element 502, the radiation pattern produced by the multi-band antenna 504 becomes substantially circular and omni directional as depicted by radiation pattern 602 in FIG. 6.

The antennas depicted in FIGS. 2-4 are examples of multi-band antennas with dual bands. Dual-band antennas have been shown for simplicity of explanation. However, these antennas are presented and intended only as examples of a multi-band antenna and not as architectural limitations. It is appreciated that the instances presented above can be extended to antennas having three, four, or more operation bands by adding gaps and additional dipole elements of lengths appropriate to add a longer dipole to the existing dipoles corresponding to the additional bands desired. Additional multi-band dipole elements can be added to improve gain.

Figure 7:
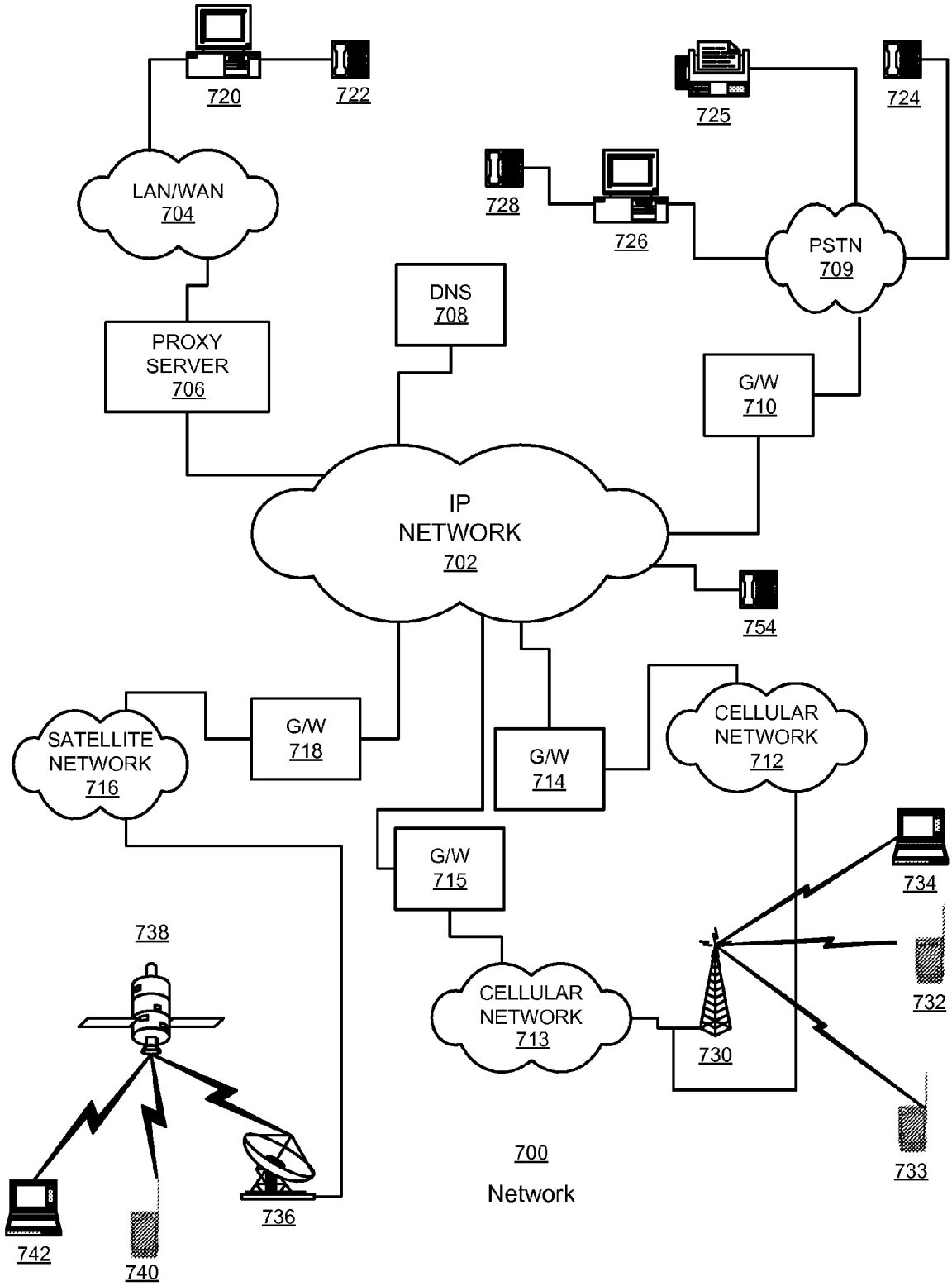
FIG. 7 depicts a system diagram illustrating a communication system in accordance with an aspect of an embodiment.

In order to provide additional context for implementing various aspects of the embodiments, FIG. 7 and the following discussion are intended to provide a brief, general description of a suitable communication network 700 in which the various aspects of the embodiments can be performed. It can be appreciated that the inventive structures and techniques can be practiced with other system configurations as well.

In FIG. 7, a system diagram illustrating a communications network 700 in accordance with an aspect of an embodiment is depicted. The communications network 700 is a plurality of interconnected heterogeneous networks in which instances provided herein can be implemented. As illustrated, communications network 700 contains an Internet Protocol (IP) network 702, a Local Area Network (LAN)/Wide Area Network (WAN) 704, a Public Switched Telephone Network (PSTN) 709, cellular wireless networks 712 and 713, and a satellite communication network 716. Networks 702, 704, 709, 712, 713 and 716 can include permanent connections, such as wire or fiber optic cables, and/or temporary connections made through telephone connections. Wireless connections are also viable communication means between networks.

IP network 702 can be a publicly available IP network (e.g., the Internet), a private IP network (e.g., intranet), or a combination of public and private IP networks. IP network 702 typically operates according to the Internet Protocol (IP) and routes packets among its many switches and through its many transmission paths. IP networks are generally expandable, fairly easy to use, and heavily supported. Coupled to IP network 702 is a Domain Name Server (DNS) 708 to which queries can be sent, such queries each requesting an IP address based upon a Uniform Resource Locator (URL). IP network 702 can support 32 bit IP addresses as well as 128 bit IP addresses and the like.

LAN/WAN 704 couples to IP network 702 via a proxy server 706 (or another connection). LAN/WAN 704 can operate according to various communication protocols, such as the Internet Protocol, Asynchronous Transfer Mode (ATM) protocol, or other packet switched protocols. Proxy server 706 serves to route data between IP network 702 and LAN/WAN 704. A firewall that precludes unwanted communications from entering LAN/WAN 704 can also be located at the location of proxy server 706.

Computer 720 couples to LAN/WAN 704 and supports communications with LAN/WAN 704. Computer 720 can employ the LAN/WAN 704 and proxy server 706 to communicate with other devices across IP network 702. Such communications are generally known in the art and are described further herein. Also shown, phone 722 couples to computer 720 and can be employed to initiate IP telephony communications with another phone and/or voice terminal using IP telephony. An IP phone 754 connected to IP network 702 (and/or other phone, e.g., phone 724) can communicate with phone 722 using IP telephony.

PSTN 709 is a circuit switched network that is primarily employed for voice communications, such as those enabled by a standard phone 724. However, PSTN 709 also supports the transmission of data. PSTN 709 can be connected to IP Network 702 via gateway 710. Data transmissions can be supported to a tone based terminal, such as a FAX machine 725, to a tone based modem contained in computer 726, or to another device that couples to PSTN 709 via a digital connection, such as an Integrated Services Digital Network (ISDN) line, an Asynchronous Digital Subscriber Line (ADSL), IEEE 802.16 broadband local loop, and/or another digital connection to a terminal that supports such a connection and the like. As illustrated, a voice terminal, such as phone 728, can couple to PSTN 709 via computer 726 rather than being supported directly by PSTN 709, as is the case with phone 724. Thus, computer 726 can support IP telephony with voice terminal 728, for example.

Cellular networks 712 and 713 support wireless communications with terminals operating in their service area (which can cover a city, county, state, country, etc.). Each of cellular networks 712 and 713 can operate according to a different operating standard utilizing a different frequency (e.g., 850 and 1900 MHz) as discussed in more detail below. Cellular networks 712 and 713 can include a plurality of towers, e.g. 730, that each provide wireless communications within a respective cell. At least some of the plurality of towers 730 can include a multi-band antenna allowing a single antenna to service both networks' 712 and 713 client devices. Wireless terminals that can operate in conjunction with cellular network 712 or 713 include wireless handsets 732 and 733 and wirelessly enabled laptop computers 734, for example. Wireless handsets 732 and 733 can be, for example, personal digital assistants, wireless or cellular telephones, and/or two-way pagers and operate using different wireless standards. For example, wireless handset 732 can operate via a TDMA/GSM standard and communicate with cellular network 712 while wireless handset 733 can operate via a UMTS standard and communicate with cellular network 713 Cellular networks 712 and 713 couple to IP network 702 via gateways 714 and 715 respectively.

Wireless handsets 732 and 733 and wirelessly enabled laptop computers 734 can also communicate with cellular network 712 and/or cellular network 713 using a wireless application protocol (WAP). WAP is an open, global specification that allows mobile users with wireless devices, such as, for example, mobile phones, pagers, two-way radios, smart phones, communicators, personal digital assistants, and portable laptop computers and the like, to easily access and interact with information and services almost instantly. WAP is a communications protocol and application environment and can be built on any operating system including, for example, Palm OS, EPOC, Windows CE, FLEXOS, OS/9, and JavaOS. WAP provides interoperability even between different device families.

WAP is the wireless equivalent of Hypertext Transfer Protocol (HTTP) and Hypertext Markup Language (HTML). The HTTP-like component defines the communication protocol between the handheld device and a server or gateway. This component addresses characteristics that are unique to wireless devices, such as data rate and round-trip response time. The HTML-like component, commonly known as Wireless Markup Language (WML), defines new markup and scripting languages for displaying information to and interacting with the user. This component is highly focused on the limited display size and limited input devices available on small, handheld devices.

Each of Cellular network 712 and 713 operates according to an operating standard, which can be different from each other, and which may be, for example, an analog standard (e.g., the Advanced Mobile Phone System (AMPS) standard), a code division standard (e.g., the Code Division Multiple Access (CDMA) standard), a time division standard (e.g., the Time Division Multiple Access (TDMA) standard), a frequency division standard (e.g. the Global System for Mobile Communications (GSM)), or any other appropriate wireless communication method. Independent of the standard(s) supported by cellular network 712, cellular network 712 supports voice and data communications with terminal units, e.g., 732, 733, and 734. For clarity of explanation, cellular network 712 and 713 have been shown and discussed as completely separate entities. However, in practice, they often share resources.

Satellite network 716 includes at least one satellite dish 736 that operates in conjunction with a satellite 738 to provide satellite communications with a plurality of terminals, e.g., laptop computer 742 and satellite handset 740. Satellite handset 740 could also be a two-way pager. Satellite network 716 can be serviced by one or more geosynchronous orbiting satellites, a plurality of medium earth orbit satellites, or a plurality of low earth orbit satellites. Satellite network 716 services voice and data communications and couples to IP network 702 via gateway 718.

FIG. 7 is intended as an example and not as an architectural limitation for instances disclosed herein. For example, communication network 700 can include additional servers, clients, and other devices not shown. Other interconnections are also possible. For example, if devices 732, 733, and 734 were GPS-enabled, they could interact with satellite 738 either directly or via cellular networks 712 and 713.

What has been described above includes examples of the embodiments. It is, of course, not possible to describe every conceivable combination of components or methodologies for purposes of describing the embodiments, but one of ordinary skill in the art may recognize that many further combinations and permutations of the embodiments are possible. Accordingly, the subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An apparatus that facilitates wireless communications, comprising a microstrip antenna with at least one dipole element with at least one radio frequency (RF) gap that allows the dipole element to resonate at more than one frequency, further comprising:

a first microstrip feedline on a first side of a dielectric material;

a second microstrip feedline on a second side of the dielectric material;

a first dipole element physically connected to the first microstrip;

a second dipole element physically connected to the second microstrip oriented with respect to the first dipole element to form a first dipole;

a third dipole element on the first side of the dielectric material linearly displaced from the first dipole element in a direction parallel to the orientation of the first dipole wherein the displacement creates a gap between the first dipole element and the third dipole element; and a fourth dipole element on the second side of the dielectric material linearly displaced from the second dipole element in a direction parallel to the orientation of the first dipole and opposite of the direction of displacement of the third dipole element from the first dipole element wherein the displacement creates a gap between the second dipole element and the fourth dipole element; wherein the gaps between the first and third dipole elements and the second and fourth dipole elements are sized such that longer wavelengths traverse the gap as if the gap were short circuited and shorter wavelengths are inhibited from crossing the gaps as if the gaps created an open circuit thereby forming dipole elements of the third dipole having a corresponding dipole wavelength longer than that of the first dipole.

2. The apparatus of claim 1, wherein the first and second microstrip feedlines, the first, second, third, and fourth dipole elements are constructed from a metal material.

3. The apparatus of claim 2, wherein the metal material is copper.

4. The apparatus of claim 1, wherein the first and second microstrip feedlines are separated by a dielectric material.

5. The apparatus of claim 4, wherein the dielectric material is constructed from a PTFE/fiberglass composite.

6. The apparatus of claim 1, wherein the first and second microstrip feedlines have an impedance of approximately 50 ohms.

7. The apparatus of claim 1, wherein the first and second dipoles have an impedance of approximately 377 ohms.

8. The apparatus of claim 1 further comprising:

a fifth dipole element on the first side of the dielectric material linearly displaced from the third dipole element in a direction parallel to the orientation of the first dipole wherein the displacement creates a gap between the third dipole element and the fifth dipole element; and a sixth dipole element on the second side of the dielectric linearly displaced from the fourth dipole element in a direction parallel to the orientation of the fourth dipole element and opposite of the direction of displacement of the fifth dipole element from the third dipole element wherein the displacement creates a gap between the fourth dipole element and the sixth dipole element; wherein the gap between the third dipole element and the fifth dipole element is greater than the gap between the first dipole element and the third dipole element, the gap between the fourth dipole element and the sixth dipole element is greater than the gap between the second dipole element and the fourth dipole element, and the gap between the third dipole element and the fifth dipole element and the gap between the fourth dipole element and the sixth dipole element are substantially equal;

the fifth and sixth dipole elements are situated such as to form, in combination with the first, second, third, and fourth dipole elements, a third dipole having a dipole frequency longer than that of the second dipole; and the gap between the third and fifth dipole elements and the gap between the fourth and sixth dipole elements is sufficiently large to inhibit transmission of electrical signals smaller than a frequency of operation of the third dipole into the fifth and sixth dipole elements but is not large enough to prevent transmission of signals corresponding to a frequency band of operation of the third dipole into the fifth and sixth dipole elements.

9. A multi-resonant antenna, comprising:

a first dipole element comprising first and second components separated by a first dielectric gap;

a second dipole element comprising third and fourth components separated by a second dielectric gap, wherein a principal length of the third component is substantially equal to a principal length of the first component, a principal length of the fourth component is substantially equal to a principal length of the second component, and the first dielectric gap length is substantially equal to the second dielectric gap length; and wherein dipoles formed by the first and second dipole elements resonate at a first frequency corresponding to a dipole wavelength substantially equivalent to a length of the first component and resonate at a second frequency corresponding to a dipole wavelength substantially equivalent to the combination of lengths of the first component, the second component, and the first dielectric gap; and the gap distances are chosen and the component lengths selected such that the dipole element resonates at multiple discrete frequency bands wherein the number of discrete frequency bands is equivalent to the number of first dipole components.

10. The multi-resonant antenna of claim 9 further comprising:

a dielectric material layer separating a first electrically conductive material from a second electrically conductive material.

11. The multi-resonant antenna of claim 10, wherein the first electrically conductive material comprises a first microstrip feedline and the second electrically conductive material comprises a second microstrip feedline each of which is coupled to a respective one of an anode and a cathode component of a radio frequency (RF) signal line.

12. The multi-resonant antenna of claim 11, wherein the first and second microstrips each of an impedance of approximately 50 ohms.

13. A multi-resonant antenna, comprising:

a first dipole element comprising a plurality of first dipole components each of which is linearly separated from an adjacent component by a dielectric gap and a first one of the first dipole components is electrically coupled to an anode component of a radio frequency (RF) signal line; and a second dipole element comprising a plurality of second dipole components each of which is linearly separated from an adjacent one of the second dipole components by a dielectric gap and a first one of the second dipole components is electrically coupled to a cathode component of a radio frequency (RF) signal line;

wherein the gap distances are chosen and the component lengths selected such that the dipole element resonates at multiple discrete frequency bands, the number of discrete frequency bands is equivalent to the number of first dipole components.

14. The multi-resonant antenna of claim 13, wherein the dipole components are constructed of a metal material.

15. The multi-resonant antenna of claim 13, wherein the first dipole element is separated from the second dipole element by a dielectric layer.

16. The multi-resonant antenna of claim 15, wherein the dielectric layer comprises a PTFE/fiberglass composite material.

17. A communications system supporting wireless communications for a plurality of wireless device operating frequencies, the communications system comprising:

a communications network; and a plurality of antennas that are geographically dispersed and support communications for wireless devices; wherein at least one of the antennas is a multi-resonant antenna capable of resonating at a plurality of operational frequencies and further comprises:

a first microstrip feedline on a first side of a dielectric material;

a second microstrip feedline on a second side of the dielectric material;

a first dipole element physically connected to the first microstrip feedline;

a second dipole element physically connected to the second microstrip feedline oriented with respect to the first dipole element so as to form a first dipole;

a third dipole element on the first side of the dielectric linearly displaced from the first dipole element in a direction parallel to the orientation of the first dipole wherein the displacement creates a gap between the first dipole element and the third dipole element; and a fourth dipole element on the second side of the dielectric material linearly displaced from the second dipole element in a direction parallel to the orientation of the first dipole and opposite of the direction of displacement of the third dipole element from the first dipole element wherein the displacement creates a gap between the second dipole element and the fourth dipole element; wherein the gaps between the first and third dipole elements and the second and fourth dipole elements are sized such that longer wavelengths traverse the gap as if the gap were short circuited and shorter wavelengths are inhibited from crossing the gaps as if the gaps created an open circuit thereby forming dipole elements for the third dipole having a corresponding dipole wavelength longer than that of the first dipole.

18. The communications system of claim 17, wherein the multi-resonant antenna comprises at least one dielectric element having two dipole components separated by a dielectric layer, wherein each dipole component comprises a plurality of dipole subcomponents linearly separated from an adjacent subcomponent by a dielectric material, wherein the lengths of the subcomponents and size of the gaps are chosen such that a single dipole element is capable of resonating at multiple operational frequencies.

19. The communications system of claim 17, wherein the multi-resonant antenna comprises:

a first dipole element comprising a plurality of first dipole components each of which is linearly separated from an adjacent component by a dielectric gap and a first one of the first dipole components is electrically coupled to an anode component of a radio frequency (RF) signal line; and a second dipole element comprising a plurality of second dipole components each of which is linearly separated from an adjacent one of the second dipole components by a dielectric gap and a first one of the second dipole components is electrically coupled to a cathode component of a radio frequency (RF) signal line;

wherein the gap distances are chosen and the component lengths selected such that the dipole element resonates at multiple discrete frequency bands wherein the number of discrete frequency bands is equivalent to the number of first dipole components.

20. An antenna element, comprising:

a first dipole element comprising a plurality of first dipole components, tuned to a first frequency having a predetermined length; and a second dipole element comprising a plurality of second dipole components, where the second dipole element is separated from the first dipole element by a predetermined gap; wherein the predetermined gap and the predetermined component length are selected such that the dipole element resonates at multiple discrete frequency bands.

21. The antenna element of claim 20, wherein the predetermined length is one fourth a length of a wavelength of a first desired frequency.

22. The antenna element as recited in claim 20, wherein the length of the first dipole element plus the length of the gap plus the length of the second dipole element is equal to one fourth a length of a wavelength of a second desired frequency.

* * * * *